US008807230B2

(12) United States Patent
Sonnier

(10) Patent No.: US 8,807,230 B2
(45) Date of Patent: Aug. 19, 2014

(54) CONTROL LINE INSTALLATION UNIT AND METHOD OF RUNNING A STRING OF TUBING INTO A WELL

(75) Inventor: Errol A. Sonnier, Broussard, LA (US)

(73) Assignee: Tesco Corporation, Houston, TX (US)

( * ) Notice: Subject to any disclaimer, the term of this patent is extended or adjusted under 35 U.S.C. 154(b) by 455 days.

(21) Appl. No.: 13/197,433

(22) Filed: Aug. 3, 2011

(65) Prior Publication Data

US 2012/0031627 A1 Feb. 9, 2012

Related U.S. Application Data

(60) Provisional application No. 61/370,275, filed on Aug. 3, 2010.

(51) Int. Cl.
*E21B 19/02* (2006.01)
*E21B 19/06* (2006.01)

(52) U.S. Cl.
USPC ..... 166/380; 166/77.51; 166/77.52; 166/77.53

(58) Field of Classification Search
USPC ..... 166/77.1, 77.51, 77.52, 77.53, 379, 166/380, 381, 385
See application file for complete search history.

(56) References Cited

U.S. PATENT DOCUMENTS

| | | | | |
|---|---|---|---|---|
| 6,131,664 | A | 10/2000 | Sonnier | |
| 7,410,003 | B2 * | 8/2008 | Ravensbergen et al. | 166/384 |
| 2003/0066654 | A1 | 4/2003 | Juhasz et al. | |
| 2004/0065874 | A1 * | 4/2004 | Newman | 254/360 |
| 2006/0108122 | A1 | 5/2006 | Buyaert et al. | |
| 2006/0137884 | A1 | 6/2006 | Torres | |

FOREIGN PATENT DOCUMENTS

| | | | |
|---|---|---|---|
| WO | 0019061 | A1 | 4/2000 |
| WO | 2004038169 | A1 | 5/2004 |

* cited by examiner

*Primary Examiner* — David Andrews
*Assistant Examiner* — Kristyn Hall
(74) *Attorney, Agent, or Firm* — Bracewell & Giuliani LLP

(57) ABSTRACT

A well tubing installer includes a base having a tubular connector extending downward for connection to an upper end of a blowout preventer. A support floor having support slips is mounted to hydraulic cylinders at a fixed distance above the base. A traveling slip base containing traveling slips is mounted to upper ends of piston rods of the hydraulic cylinders. A pipe lifting assembly is supported by the base for lifting and positioning an additional joint of tubing to be added to the string of tubing. A pipe make-up mechanism is supported by the base for rotating the additional joint into threaded engagement with the string of tubing. A control line supply source for supplies control line to and alongside the string of tubing at a point between the base and the support floor.

18 Claims, 4 Drawing Sheets

CONTROL LINE INSTALLATION UNIT AND METHOD OF RUNNING A STRING OF TUBING INTO A WELL

CROSS-REFERENCE TO RELATED APPLICATION

This application claims priority to provisional application Ser. No. 61/370,275, filed Aug. 3, 2010.

FIELD OF THE DISCLOSURE

This disclosure relates in general to clamping control lines to a string of tubing being lowered into a well, and in particular to a unit that feeds the control lines below a lower set of slips while an upper set of slips lowers the string of tubing.

BACKGROUND OF THE DISCLOSURE

Oil and gas wells often produce well fluids through a string of tubing suspended in the well. The string of tubing may have hydraulically operated devices, such as valves and sliding sleeves, mounted in the tubing string below the wellhead. One or more hydraulic controls lines are strapped alongside the tubing and extend from the device to the wellhead for controlling the device.

U.S. Pat. No. 6,131,664 discloses an assembly that facilitates aligning the control lines with the tubing as the tubing is being installed. The assembly provides a space below the slips that hold the tubing string for inserting the control lines. The assembly locates on a rig floor of an existing drilling rig. While the assembly works well, it may be too large to be placed on the rig floor of smaller rigs such workover rigs used for land operations.

SUMMARY

An apparatus for running a string of tubing into a well has a base having a tubular connector extending downward for connection to an upper end of a blowout preventer assembly. The tubular connector has a passage extending through along a longitudinal axis of the tubular connector. A plurality of legs are mounted to and extending upward from the base, the legs being spaced circumferentially around the axis. A support floor is mounted to the legs above the base, the support floor having a support floor opening containing a set of support slips for supporting the string of tubing. A pipe handling assembly extends upward above the support floor for securing an additional joint of tubing to the string of tubing. A control line supply source supplies control line to the string of tubing at a point between the base and the support floor.

In one embodiment, an external flange on the tubular connector is employed for bolting the tubular connector to the blowout preventer assembly such that the weight of the base, the support floor and the pipe handling assembly passes through the flange to the blowout preventer assembly.

Preferably, a traveling slip base is located above the support floor. A set of traveling slips is mounted to the traveling slip base for supporting the string of tubing while the support slips are released. A hydraulic mechanism moves the traveling slip base axially relative to the support floor to lower the string of tubing into the well.

In the embodiment shown, each of the legs comprises a cylinder of a hydraulic cylinder assembly also having a piston rod that may be extended upward from the cylinder. The traveling slip base is mounted to upper ends of the piston rods for axial movement therewith.

In one embodiment, a make-up carriage is mounted to support floor. A power tong assembly having a back-up tong and a make-up tong is mounted to the make-up carriage. The make-up carriage is laterally movable relative to support floor to position the power tong assembly for engagement with the string of tubing.

In one embodiment, the pipe handling assembly comprises a mast mounted to and extending upward from the support floor. A lifting mechanism is mounted to the mast and has a tubing engaging member for engaging and lifting the additional joint of tubing to be added to the string of tubing. The mast may be telescoping and have a sheave at its upper end. A winch mounted to the mast is wrapped with a lifting line extending over the sheave. A tubing engaging member on an end of the lifting line engages and lifts the additional joint of tubing to be added to the string of tubing.

DETAILED DESCRIPTION OF THE DISCLOSURE

Figure 1:
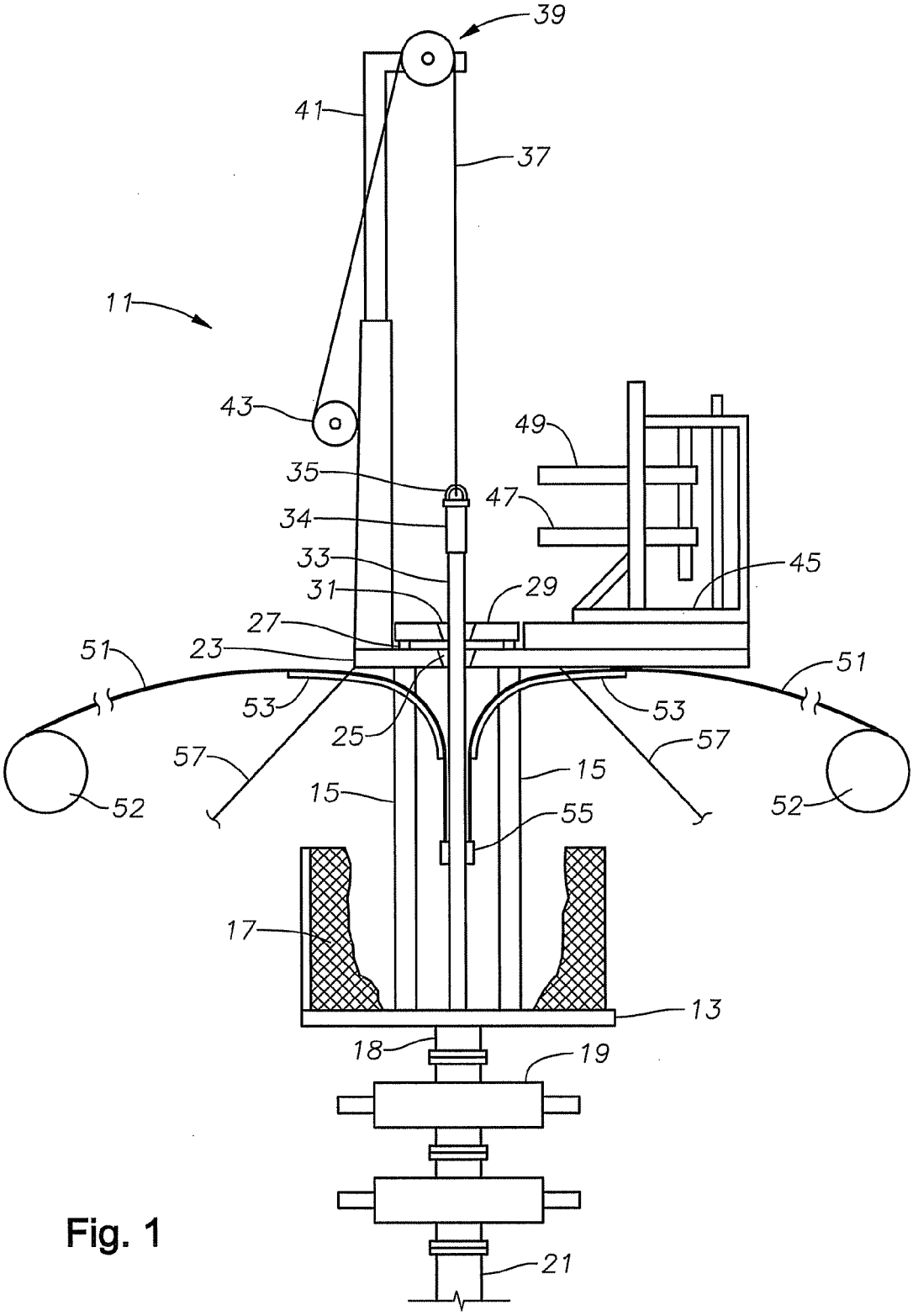
FIG. 1 is a partially schematic side elevational view of a unit for running a string of tubing and clamping control lines to the tubing.

Referring to FIG. 1, unit 11 has a base or rig floor 13. Rig floor 13 supports the lower ends of a plurality of vertically oriented hydraulic cylinders 15. In the preferred embodiment, there are four hydraulic cylinders 15 spaced in a rectangular array. Rig floor 13 may have a safety fence 17 surrounding it, a portion of which is shown broken out in the figures to illustrate hydraulic cylinders 15. Rig floor 13 has an adapter 18 that extends downward from it to mount unit 11 on a wellhead assembly. In this example, adapter 18 comprises a tubular member with an external flange on a lower end that bolts to the upper end of a blowout preventer assembly (BOP) 19. Adapter 18 secures the unit 11 to the upper end of BOP 19 and has a passage through it for passing pipes and tools into the well bore. In this example, BOP 19 comprises two blowout preventers, one on top the other, but a single blowout preventer or more than two would be satisfactory. The lower blowout preventer of BOP 19 is connected to the top of a tubing head 21. Tubing head 21 comprises part of a wellhead assembly, typically for a land based well.

Unit 11 also has a pipe make-up or support floor 23 positioned above rig floor 13. Pipe make-up floor 23 is supported on the upper ends of the cylinders of hydraulic cylinders 15, which serve as legs. Pipe make-up floor 23 has a set of lower slips or a spider 25 mounted within it. Lower slips 25 are preferably power actuated and will move between a pipe gripping position and a pipe releasing position. Lower slips 25 comprises segments that slide downward on conical surfaces of a bowl to engage and are lifted upward relative to the bowl by hydraulic cylinders to disengage. In a pipe gripping position, lower slips 25 will support the weight of a string of pipe. Pipe make-up floor 23 and lower slips 25 are at a fixed distance above rig floor 13.

Hydraulic cylinders 15 have pistons 27 that stroke between upper and lower positions. In this example, pistons 27 are double acting; that is, they are powered to extend and retract.

Figure 3:
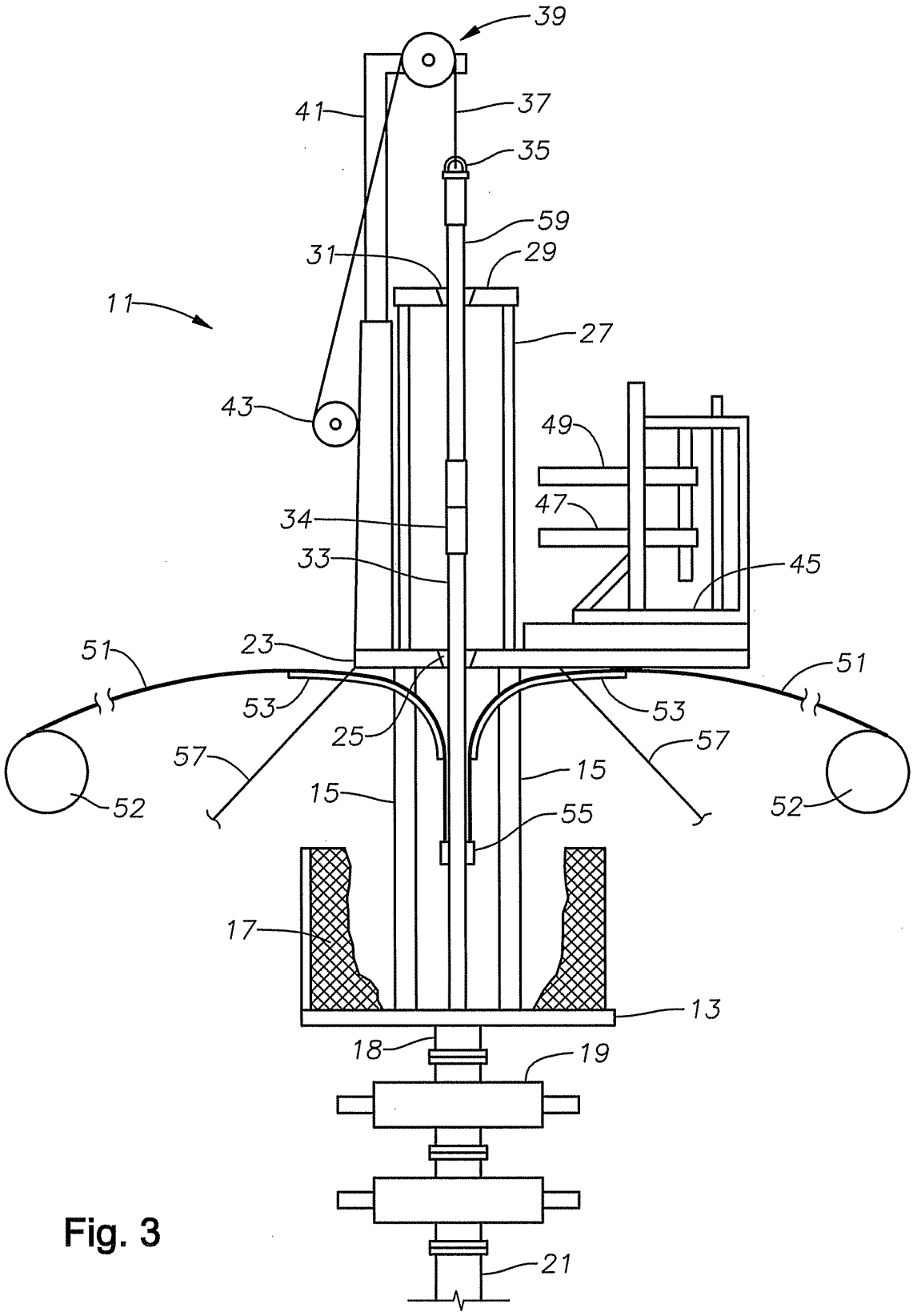
FIG. 3 is a view similar FIG. 2, but showing upper slips extended to an upper position to engage the string of tubing.

A traveling slip base 29 mounts to the upper ends of pistons 27 for movement therewith. Traveling slip base 29 is a plate that supports a set of upper slips or a spider 31. Upper slips 31 may be identical to lower slips 25 except they are moved vertically relative to lower slips 25 when pistons 27 are stroked between the upper and lower positions. Upper slips 31 are also preferably power actuated between a released position and a pipe gripping position. Upper slips 31 will also support the weight of a string of pipe. FIG. 1 shows upper slips 31 in a lower position, and FIG. 3 shows upper slips 31 in an upper position. In this example, upper slips 31 only support a downward force due to weight of pipe, and are not capable of exerting a downward force on a string of pipe to force pipe into a well under pressure.

In this embodiment, a string of pipe comprising production tubing 33 is being lowered into the well with unit 11. Production tubing 33 comprises sections of pipe, typically about 30-40 feet long, that have external threads at each end. An internally threaded sleeve or coupling 34 secures each joint of tubing 33 to another. During running, tubing string 33 extends through adapter 18, BOP 19, and tubing head 21. After tubing string 33 is completely installed, BOP 19 is removed and the well is completed. Hydrocarbons being produced from the well will flow through tubing string 33 and out flow lines connected to tubing head 21.

In this embodiment, a lift cap 35 is secured by threads to the coupling 34 on the uppermost joint of tubing 33. A lift line 37 extends up over a sheave assembly 39 at the upper end of a mast 41. Preferably mast 41 is a telescoping type and is hydraulically actuated between retracted and extended positions. A winch 43 is mounted to a lower portion of mast 41, and lift line 37 extends around winch 43. Winch 43 may be actuated to lower and raise lift cap 35. Winch 43, lift line 37 and mast 41 have the capability of lifting a single joint of tubing string 33, but need not have the capability of supporting an entire tubing string 33.

A make-up carriage 45 is mounted to pipe make-up floor 23. Make-up carriage 45 moves laterally between an outer storage position inward to an inner operational position. FIG. 1 shows make-up carriage 45 in the storage position and FIG. 2 in the operational position. Make-up carriage 45 has a drive system (not shown) that will cause it to move selectively between the storage and operational positions. Conventional powered pipe make-up equipment mounts to make-up carriage 45 for making up couplings 34 of tubing string 33. The make-up equipment includes a backup tong 47 and a make-up tong 49 mounted above backup tong 47.

A plurality of control lines 51 (two shown) are shown being attached to the string of tubing 33 in FIG. 1. Control lines 51 may be hydraulic control lines that supply hydraulic fluid pressure to various downhole components in the string of tubing 33. These components could be valves, sliding sleeves or other devices. The control lines may also include electrical lines that supply electrical power and receive signals from sensors downhole. Control lines 51 are deployed from spools or reels 52 that would be mounted at the ground level. Each control line 51 passes over a guide 53 that bends the control line in a gradual arc into vertical alignment alongside tubing string 33. Control lines 51 and guides 53 are located below make-up floor 23 and above rig floor 13. Control lines 51 do not pass through either of the slips 25, 31; rather they are brought alongside tubing string 33 below lower slips 25. Personnel standing on rig floor 13 will connect control lines 51 to tubing string 33 by using conventional brackets or clamps 55.

Personnel may also be present on make-up carriage 45 for controlling the make-up of tubing string 33 with tongs 47 and 49. Ladders or stairs may be mounted between rig floor 13 and ground and between make-up floor 23 and ground. A number of guy wires 57 are preferably connected between make-up floor 23 and ground to provide vertical stabilization.

Figure 2:
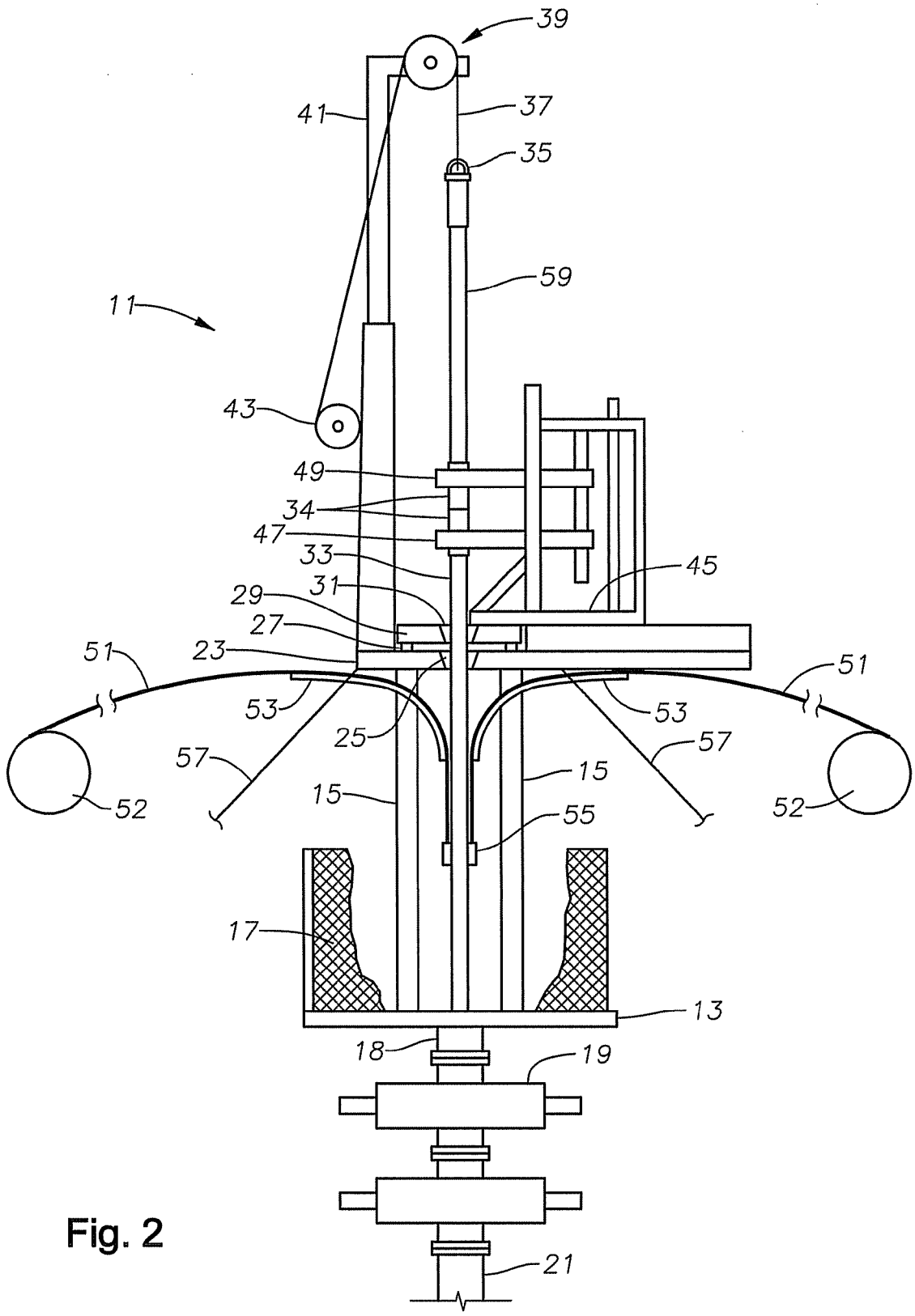
FIG. 2 is a view of the unit of FIG. 1, showing an additional joint of tubing being secured to the string of tubing.

In operation, FIG. 1 shows tubing string 33 being supported by lower slips 25. The uppermost joint of tubing string 33 is positioned at a desired elevation above make-up floor 23 for engagement by backup tongs 47. Pistons 27 are in the fully retracted position with traveling slip base 29 in it lower position. At that point, the operator will remove lift cap 35 from tubing string 33 and secure it to a new joint 59 of tubing, also referred to herein as an add-on joint. The add-on joint 59, which is shown in FIG. 2, will be picked up from a pipe rack and lifted so that it is in vertical alignment with tubing string 33 as shown in FIG. 2. The operator lifts the add-on joint 59 by using winch 43 and lift line 37. The operator then moves make-up carriage 45 into the operational position shown in FIG. 2. Backup tong 47 will engage tubing string 33 below coupling 34, and make-up tong 49 will engage add-on joint 59, respectively. With make-up tong 49, the operator rotates add-on joint 59 while holding tubing string 33 against rotation with backup tong 47. The operator then disengages tongs 47, 49 and moves make-up carriage 45 back to the storage position shown in FIG. 3.

Figure 4:
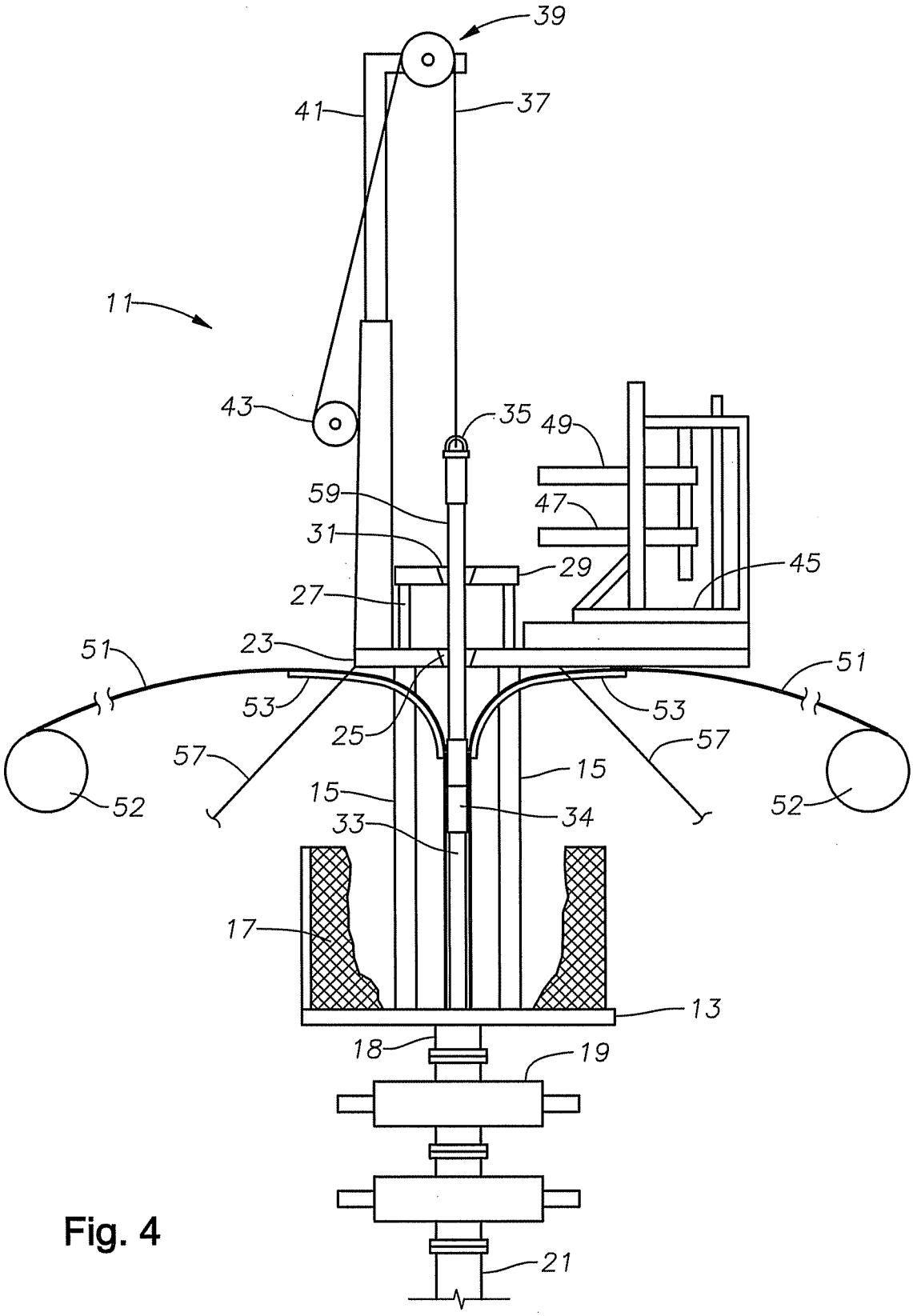
FIG. 4 is a view similar to FIG. 3, but showing the upper slips and the string of tubing being lowered.

While upper slips 31 are in a disengaged position, the operator then will move traveling slip base 29 to an upper position by causing pistons 27 to move upward. Once near the upper position, which is shown in FIG. 3, the operator actuates upper slips 31 to engage add-on joint 59. The operator then supplies pressure to move pistons 27 farther upward, causing upper slips 31 to lift the entire tubing string 33, which now includes add-on joint 59, a short distance. The operator then will move lower slips 25 to the released position, with upper slips 31 supporting the weight of tubing string 33. If the weight of tubing string 33 is sufficient, the operator then will allow hydraulic fluid pressure to bleed from hydraulic cylinders 15 at a desired rate so as to lower tubing string 33 by gravity until pistons 27 reach a fully retracted position. If tubing string 33 comprises only a few joints of tubing, the weight may not be sufficient to cause pistons 27 to retract quickly enough. In that instance, the operator will apply pressure to pistons 27 to cause them to retract. FIG. 4 shows add-on joint 59 being lowered from the position in FIG. 3. While tubing string 33 descends, the operator feeds control lines 51 from spools through guides 53 and alongside tubing string 33. The operator also plays out lift line 37 from winch 43 while tubing string 33 descends so that no tension will be within lift line 37.

When traveling slip base 29 reaches its lower position, the upper end of add-on joint 59 will not yet be located in the make-up position above make-up floor 23. Rather the upper end of add-on joint 59 will be spaced a greater distance from make-up floor 23 than make-up tong 49. Depending upon the lengths of pistons 27 and the longer length of add-on joint 59, the operator may need to stroke pistons 27 between the extended and retracted positions a few times in order to position coupling 34 on add-on joint 59 at a lower elevation than make-up tong 49. Consequently, if traveling slip base 29 is still not at the desired elevation above make-up floor 23, the operator will repeat the cycle. He will engage lower slips 25 with tubing string 33, disengage upper slips 31, and stroke pistons 27 back to near an uppermost position to again grip add-on joint 59. Eventually, coupling 34 of add-on joint 59 will be located in approximate horizontal alignment with tongs 47, 49, which is slightly lower than make-up tong 49.

The tubing string 33, now including add-on joint 59, will be in the position of FIG. 1, ready for receiving an another add-on joint 59 of tubing.

If the operator is securing one clamp 55 for every joint of tubing 33, the operator will be in a position to secure a new control line clamp 55 when a new joint 59 of tubing is to be added. Personnel located on rig floor 13 will connect clamp 55 around tubing 33, securing control lines 51.

After running tubing string 33 to the desired depth, a tubing hanger (not shown) will be secured to the upper end of tubing string 33 and landed in tubing head 21. The operator removes BOP 19 and unit 11 and completes the well for production.

The unit described avoids the need for a workover or drilling rig for running tubing. The unit not only runs the tubing, it also facilitates strapping control lines to the tubing as the tubing is being lowered into the well.

While the disclosure has been shown in only one of its forms, it should be apparent to those skilled in the art that it is not so limited but is susceptible to various changes without departing from the scope of the disclosure.

The invention claimed is:

1. An apparatus for running a string of tubing into a well, comprising:

a base having a tubular connector extending downward for connection to an upper end of a blowout preventer assembly, the tubular connector having a passage extending through along a longitudinal axis of the tubular connector;

a plurality of legs mounted to and extending upward from the base, the legs being spaced circumferentially around the axis;

a support floor mounted to the legs above the base, the support floor having a support floor opening containing a set of support slips for supporting the string of tubing;

a pipe handling assembly extends upward above the support floor for securing an additional joint of tubing to the string of tubing;

a control line supply source for supplying control line to the string of tubing at a point between the base and the support floor; wherein the pipe handling assembly comprises:

a make-up carriage mounted to the support floor;

a power tong assembly having a back-up tong and a make-up tong mounted to the make-up carriage; and wherein the make-up carriage is laterally movable relative to the support floor to position the power tong assembly for engagement with the string of tubing.

2. The apparatus according to claim 1, further comprising:

an external flange on the tubular connector for bolting the tubular connector to the blowout preventer assembly such that the weight of the base, the support floor and the pipe handling assembly passes through the flange to the blowout preventer assembly.

3. The apparatus according to claim 1, further comprising:

a traveling slip base located above the support floor;

a set of traveling slips mounted to the traveling slip base for supporting the string of tubing while the support slips are released; and a hydraulic mechanism for moving the traveling slip base axially relative to the support floor to lower the string of tubing into the well.

4. The apparatus according to claim 1, wherein each of the legs comprises a cylinder of a hydraulic cylinder assembly also having a piston rod that may be extended upward from the cylinder; and the apparatus further comprises:

a traveling slip base mounted to upper ends of the piston rods for axial movement therewith; and a set of traveling slips mounted to the travelling slip base for supporting the string of tubing while the support slips are released.

5. The apparatus according to claim 1, wherein the pipe handling assembly comprises:

a mast mounted to and extending upward from the support floor; and a lifting mechanism mounted to the mast and having a tubing engaging member for engaging and lifting the additional joint of tubing to be added to the string of tubing.

6. The apparatus according to claim 1, wherein the pipe handling assembly comprises:

a telescoping mast mounted to and extending upward from the support floor, the mast having a sheave at an upper end;

a winch mounted to the mast;

a lifting line extending around the winch and over the sheave; and a tubing engaging member on an end of the lifting line for engaging and lifting the additional joint of tubing to be added to the string of tubing.

7. The apparatus according to claim 1, wherein the pipe handling assembly comprises:

a mast mounted to and extending upward from the support floor;

a lifting mechanism mounted to the mast and having a tubing engaging member for engaging and lifting the additional joint of tubing to be added to the string of tubing; and wherein the apparatus further comprises:

a traveling slip base located above the support floor;

a set of traveling slips mounted to the traveling slip base for supporting the string of tubing while the support slips are released; and a hydraulic mechanism for moving the traveling slip base axially relative to the support floor to support an entire weight of the string of tubing and lower the string of tubing into the well.

8. The apparatus according to claim 1, further comprising:

a mast mounted to and extending upward from the support floor;

a lifting mechanism mounted to the mast and having a tubing engaging member for engaging and lifting the additional joint of tubing to be added to the string of tubing; and wherein the apparatus further comprises:

a traveling slip base located above the support floor;

a set of traveling slips mounted to the traveling slip base for supporting the string of tubing while the support slips are released; and a hydraulic mechanism for moving the traveling slip base axially relative to the support floor to support an entire weight of the string of tubing and lower the string of tubing into the well.

9. An apparatus for running a string of tubing into a well, comprising:

a base having a tubular connector extending downward for connection to an upper end of a blowout preventer assembly, the tubular connector having a passage extending through along a longitudinal axis of the tubular connector;

a plurality of hydraulic cylinders mounted to and extending upward from the base, the hydraulic cylinders being spaced circumferentially around the axis and having extending piston rods;

a support floor mounted to the hydraulic cylinders at a fixed distance above the base, the support floor having a support floor opening containing a set of support slips for supporting the string of tubing;

a traveling slip base mounted to upper ends of the piston rods for axial movement therewith relative to the support floor;

a set of traveling slips mounted to the traveling slip base for supporting the string of tubing while the support slips are released;

a pipe lifting assembly supported by the base for lifting and positioning an additional joint of tubing for addition to the string of tubing;

a pipe make-up mechanism supported by the base for rotating the additional joint into threaded engagement with the string of tubing; and a control line supply source for supplying control line to and alongside the string of tubing at a point between the base and the support floor.

10. The apparatus according to claim 9, wherein the pipe lifting assembly is mounted to the support floor.

11. The apparatus according to claim 9, wherein the pipe lifting assembly comprises:

a telescoping mast mounted to and extending upward from the support floor, the mast having a sheave at an upper end;

a winch mounted to the mast;

a lifting line extending around the winch and over the sheave; and a tubing engaging member on an end of the lifting line for engaging and lifting the additional joint of tubing to be added to the string of tubing.

12. The apparatus according to claim 9, wherein the pipe make-up mechanism is mounted to the support floor.

13. The apparatus according to claim 9, wherein the pipe make-up mechanism comprises:

a make-up carriage mounted to support floor;

a power tong assembly having a back-up tong and a make-up tong mounted to the make-up carriage; and wherein the make-up carriage is laterally movable relative to support floor to position the power tong assembly for engagement with the string of tubing.

14. The apparatus according to claim 9, further comprising:

an external flange on the tubular connector for bolting the tubular connector to the blowout preventer assembly such that the weight of the base, the support floor and the pipe handling assembly passes through the flange to the blowout preventer assembly.

15. The apparatus according to claim 9, further comprising:

a curved guide member mounted below the support floor for guiding the control line into engagement with the string of tubing.

16. A method of running a string of tubing into a well, comprising:

(a) providing a base with a tubular connector extending downward and legs extending upward, a support floor mounted to the legs above the base, the support floor having a support floor opening containing a set of support slips, and a pipe handling assembly mounted to and extending upward from the support floor;

(b) connecting the tubular connector to an upper end of a blowout preventer assembly;

(c) supporting the string of tubing with the support slips;

(d) with the pipe handling assembly, picking up an additional joint of tubing and securing the additional joint of tubing to the string of tubing while supported by the support slips;

(e) supplying a control line to and alongside the string of tubing at a point between the base and the support floor, and clamping the control line to the string of tubing;

(f) lowering the string of tubing into the well; wherein step (a) further comprises mounting a traveling slip base and a set of traveling slips above the support floor; and step (f) comprises gripping the string of tubing with the traveling slips and lowering the traveling slip base relative to the support floor.

17. The method according to claim 16, wherein step (b) comprises passing the weight of the string of tubing, the base, the support floor and the pipe handling assembly to the blowout preventer.

18. The method according to claim 16, wherein:

mounting the traveling slip base comprises mounting the traveling slip base on hydraulic cylinder piston rods; and lowering the traveling slip base comprises retracting the piston rods while supporting the weight of the string of tubing.

* * * * *